United States Patent [19]

Pohto

[11] Patent Number: 4,936,971

[45] Date of Patent: Jun. 26, 1990

[54] MASSIVE ANODE AS A MOSAIC OF MODULAR ANODES

[75] Inventor: Gerald R. Pohto, Mentor, Ohio

[73] Assignee: ELTECH Systems Corporation, Boca Raton, Fla.

[21] Appl. No.: 175,472

[22] Filed: Mar. 31, 1988

[51] Int. Cl.[5] ..... C25C 7/00

[52] U.S. Cl. ..... 204/242; 204/286; 204/288; 204/290 R; 204/291; 204/292; 204/290 F

[58] Field of Search ..... 204/280, 286, 288, 289, 204/290 F, 290 R, 291, 242, 292, 279

[56] References Cited

U.S. PATENT DOCUMENTS

| | | | |
|---|---|---|---|
| 3,265,526 | 8/1966 | Beer | 117/50 |
| 3,632,498 | 1/1972 | Beer | 204/290 F |
| 3,711,385 | 1/1973 | Beer | 204/59 |
| 3,887,396 | 6/1975 | Walsh et al. | 204/45.1 |
| 4,364,811 | 12/1982 | Fabian et al. | 204/220 |
| 4,528,084 | 7/1985 | Beer et al. | 204/290 |
| 4,642,173 | 2/1987 | Koziol et al. | 204/242 |

OTHER PUBLICATIONS

Nikko Wolverine Inc. Data Sheet.

*Primary Examiner*—John F. Niebling
*Assistant Examiner*—Kathryn Gorgos
*Attorney, Agent, or Firm*—John J. Freer

[57] ABSTRACT

A massive anode is assembled from many, closely packed modular anodes. Although close-packed, the modular anodes are nevertheless spaced apart one from the other. The massive anode has at least substantial inflexibility. It can be particularly useful where a flexible cathode may move toward, and even contact, the anode, e.g., in electrogalvanizing where a moving sheet from a metal coil being coated may thump against the anode. The individual modular anodes provide a collective, generally planar front face toward the cathode. Individual, adjacent modular anodes can be separated at least in part by dielectric spacing members which have portions extending toward the cathode, thereby initially receiving any impact from the cathode.

50 Claims, 3 Drawing Sheets

MASSIVE ANODE AS A MOSAIC OF MODULAR ANODES

BACKGROUND OF THE INVENTION

The use of non-sacrificial anodes for the continuous electrolytic coating of large objects, e.g., metal plating of steel coils, is well known. A representative electrolytic deposition process is electrogalvanizing. For such deposition, a substrate metal, such as steel in sheet form feeding from a coil, is run through an electrolytic coating process, often at high line speed. It has been known to design the anodes for such a process wherein characteristics such as electrolyte flow as well as other dynamics must be taken into consideration.

For example in U.S. Pat. No. 4,642,173 an electrode has been shown which has been designed by taking into consideration not only the high power requirements for an electrogalvanizing operation, but also considering control and direction of electrolyte flow pattern. In the structure of the patent, elongated lamellar anodes are positioned by bar-shaped current distributors onto sheet connectors attached to a current feed post.

It has also been known in other electrolytic operation to assemble parallel strips or finned type conductors from current distributor sheets. These sheets may be in current-conducting contact with main current distributor bars to which current is supplied by posts such as has been shown in U.S. Pat. No. 4,364,811.

There is still however the need for anode structures that can be utilized in deposition operation such as electrogalvanizing, which structures provide for economy of operation, coupled with ease and economy in replacement or repair, including anode recoating. It would also be highly desirable to have such anode structure not only be efficient and economical, but also be ruggedly constructed to handle the rigors of line operation in the steel coating industry. It can also be necessary for such anode structure to maintain continuous operation while sustaining casual shorts without disrupting continuous, uniform deposition.

Moreover, in some industrial installations it is necessary that anodes not only be of rugged construction but also maintain an inflexible, fixed position. For example, where an anode is placed in an electrolyte useful for electrogalvanizing a steel coil and the coiled steel is moving rapidly in front of, and close to, the anode face, owing to such cathode movement it is desirable to have the anode in fixed position to provide for continuous uniformity of product. It is also necessary to provide for ruggedness of anode construction as the fast moving cathode in such electrolysis operation may, during excessive movement, come into colliding contact with the anode surface.

SUMMARY OF THE INVENTION

An improved, highly efficient and rugged anode structure has now been constructed. The structure has desirable inflexibility such as for use with a moving cathode where an anode of fixed position may be needed. Modular construction provides for sustaining casual shorts without destroying a significant portion of the overall anode structure. Furthermore, such construction can provide for ease and economy of anode reconstruction and repair. Ruggedness of construction coupled with efficiency of operation, and including resistance to attack from the operating environment, leads to extended economical operation including desirable release of by-products, as in gas evolution, without deleterious loss of efficiency of operation.

In a broad aspect, the invention is directed to a massive anode of generally planar shape and at least substantial inflexibility, which contains a mosaic of modular anodes and is adapted for use with a facing, moving cathode, including movement towards the anode, which anode comprises a multitude of individual non-consumable modular anodes having planar-shaped, electrically conductive metal members with active anode front faces in a common plane, thereby presenting a generally planar front face for the anode, with each modular anode being in firm, electrically conductive contact with an electrically conductive support plate member serving as a current distributor member for the modular anodes, a series of linear, dielectric strip members mounted on the support plate member and positioned next to at least some of the edges of adjacent modular anodes, including dielectric strip members that project forwardly beyond the front faces of the modular anodes toward the facing cathode, and metal connector means securing each modular anode in electrical connection to the support plate member while spacing each modular anode and support plate member apart from one another.

In other aspects, the invention relates to a modular anode such as for use in the massive anode as described hereinbefore as well as to buss work for such massive anode that is both highly electrically conductive as well as resistant to corrosive environment that can be associated with the use of the anode. Still other aspects include an electrolysis cell incorporating such massive anode, the utilization of the anode in a cell and a special electrode support assembly for the anode.

DESCRIPTION OF THE PREFERRED EMBODIMENTS

The anode of the present invention can find particular utility in electrodeposition operation in an electrolytic cell wherein a deposit, e.g., a deposit of metal such as a zinc-containing deposit, is provided on a cathode. Exemplary of such operations is the electrogalvanizing of a substrate metal strip such as a steel strip. The anode can be particularly utilized in an electrodeposition operation wherein the cathode is a moving cathode, such as a moving sheet of steel as in an electrogalvanizing operation of coiled steel in strip form. For convenience, the anode may often be described herein in reference to use in an electrodeposition operation, and for illustrative purposes such operation may often be referred to as an electrogalvanizing operation. However, it is to be understood that the anode is contemplated for use in electrolytic cells utilizing other electrodeposition processes, e.g., the deposition of metals such as cadmium, nickel or tin, plus metal alloys as exemplified by nickel-zinc alloys, as well as in operations other than electrodeposition such as anodizing, electrophoresis and electropickling.

For convenience, the anode will usually be referred to herein as a "massive anode". By this, it is meant that the fully assembled anode is a collective of a number of individual, smaller anode units which can, in and of themselves, function as anodes. Thus it is to be understood that the massive anode need not, in scale, be of any particular size, but need only be assembled from the individual subassembly units. These units for convenience will often be referred to herein as "anode modules". By this, it is meant a subassembly, which itself may serve as an anode, but which is to be utilized with similar subassemblies, e.g., collocated in rows of similar or like anode modules, with stacks of rows being employed if desired, to form the massive anode. The anode modules may comprise a plate bearing protruding anode strips which can be referred to as "blades" or "fins" or "lamella", with the plate being thus a "finned plate" or the like.

Figure 1:
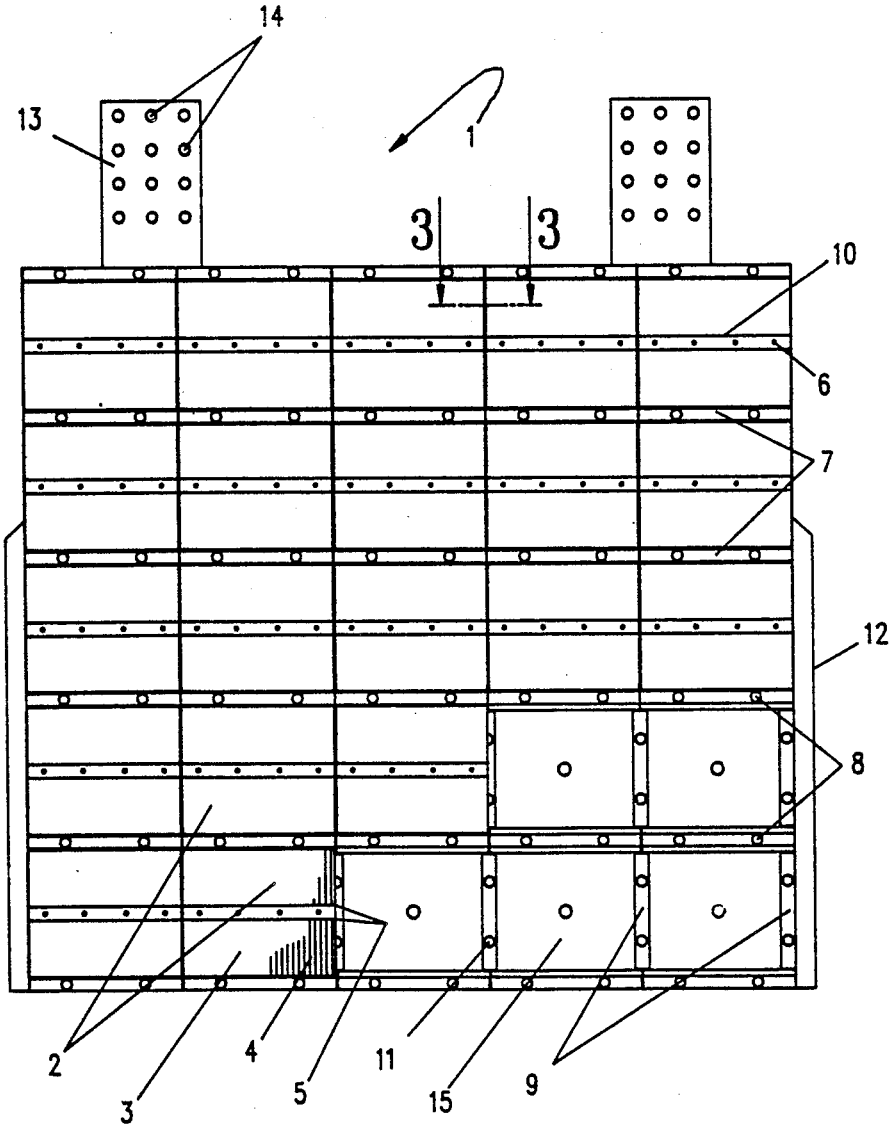
FIG. 1 is a front elevational view of a massive anode of the present invention.

In reference to the drawings, the same identifying number has generally been used for the same element in each of the figures. For convenience, reference may be made herein to elements of the drawings in vertical or horizontal position, but such is to be understood as not limiting the invention as to its positioning in use. Referring then to FIG. 1, a massive anode is shown generally at 1. This illustrative massive anode 1 is shown in partial assembly. When completed, it would be assembled from twenty-five (25) anode modules 2. The anode modules 2 are set side-by-side in horizontal rows, five to a row and the rows are stacked atop one another providing a five row vertical stack for this particular massive anode 1. For this partial assembly of the figure, only twenty (20) anode modules 2 are shown. The anode modules 2 each have a generally planar shaped face plate member 3. On each face plate member 3, there are a series of parallel, vertical metal elements 4 in the nature of "fins" or "blades" projecting out from the face plate member 3 (and shown only partially and on only one face plate member 3 in the figure). Cutting into the blade elements 4, transverse thereto, is a horizontal groove 5. Each horizontal groove 5 contains an insulating strip 10 joined to the face plate member 3 by fasteners 6.

Adjacent edges of face plate member 3 in each row of anode modules 2 are set vertically slightly apart one from the other. The horizontal edges of the face plate members 3 are separated into rows of such members 3 by horizontal dielectric strips 7. The dielectric strips 7 are bolted to a support plate 15 by corrosion resistant bolts 8. As shown by the partial cutaway of the figure, at the vertical edges of adjacent modules 2 that are side-by-side in rows, there are placed vertical dielectric strips 9 which serve as compression supports, beneath edges of the metal face members 3. These vertical dielectric strips 9 are affixed to the support plate 15 by support bolts 11. Owing to their compression support function, these strips 9 may also be referred to herein as "compression supports 9." Along the side of the massive anode 1 are edge mask guides 12 and the anode 1 at its top, has a pair of buss connectors 13. The buss connectors 13 are provided with apertures 14 through which fasteners, not shown, bind the connectors 13 with the buss work of another cell, or are used for electrical connection external to the cell.

Figure 2:
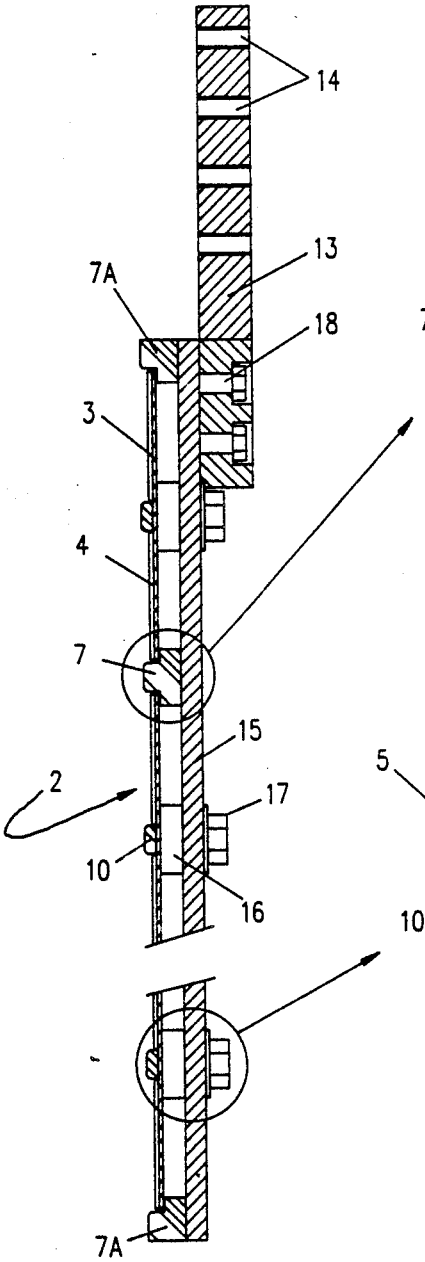
FIG. 2 is a cross-sectional, side-elevational view of the anode of FIG. 1.

Referring then to FIG. 2, the massive anode 1 has modules 2 each fastened to a support plate 15. The anode modules 2 are equipped with blade elements 4 on a face plate member 3. The individual anode modules 2 at their horizontal edges are separated in rows by dielectric strips 7. The individual anode modules 2 are connected to the support plate 15 by fasteners 16, as shown and more particularly described by reference to FIG. 2A. The fasteners 16 for each module 2 are of the same depth, whereby the face plate members 3 are in an array arranged side-by-side and row-upon-row, making up a total, planar active anode face in a common plane. Positioned centrally of each module, are horizontal insulating strips 10. Rearwardly of the support plate 15, the metal plate fasteners terminate in a bolt 17. The dielectric strips 7 include edge strips 7A located atop and at the bottom of the stacks of anode modules 2. At its top, the support plate 15 is connected through fasteners 18 with a buss connector 13. The buss connector 13 has apertures 14 for external connection or the like. For purposes of convenience, the vertical compression supports 9 are not shown in this figure, where they would occupy the space between the support plate 15 and the face plate member 3.

Figure 2B:
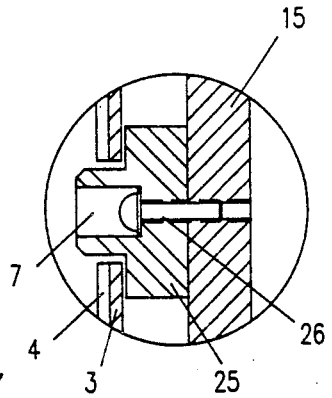
FIG. 2B is a magnified view of a section of the anode of FIG. 2.
Figure 2A:
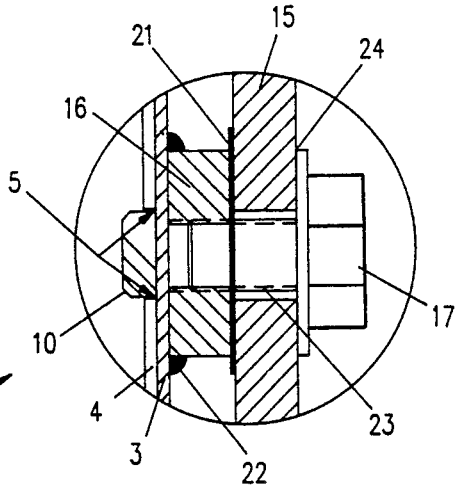
FIG. 2A is a magnified view of a portion of the anode of FIG. 2 in partial section.

In FIG. 2A, the anode module face plate member 3 has projecting blade elements 4. The face plate member 3 is connected through a metal connector, or boss, 16 to a support plate 15. Interposed between the metal connector 16 and support plate 15, is a voltage-minimizing metal coating 21. The metal connector 16 and coating 21 space the face plate member 3 apart from the support plate 15, permitting the plate member 3 to project "forwardly" or "outwardly" from the support plate 15, as such terms are used herein. The face plate member 3 is fastened to the metal connector 16 at least in part by current-carrying welds 22. Additionally, the metal connector 16 and support plate 15, are brought together by a fastener 23. The fastener 23 terminates rearwardly of the support plate 15 in a washer 24 plus threaded bolt 17. In a groove 5 on the face plate member 3 is a horizontal insulator strip 10.

Then as shown in FIG. 2B, anode module face plate members 3 have blade elements 4. Adjacent parallel horizontal edges of these face plate members 3 are spaced apart by dielectric strips 7. The dielectric strips 7 are composed of an insulator element 25 fastened by a countersunk bolt 26 which is threaded into the support plate 15.

Figure 3:
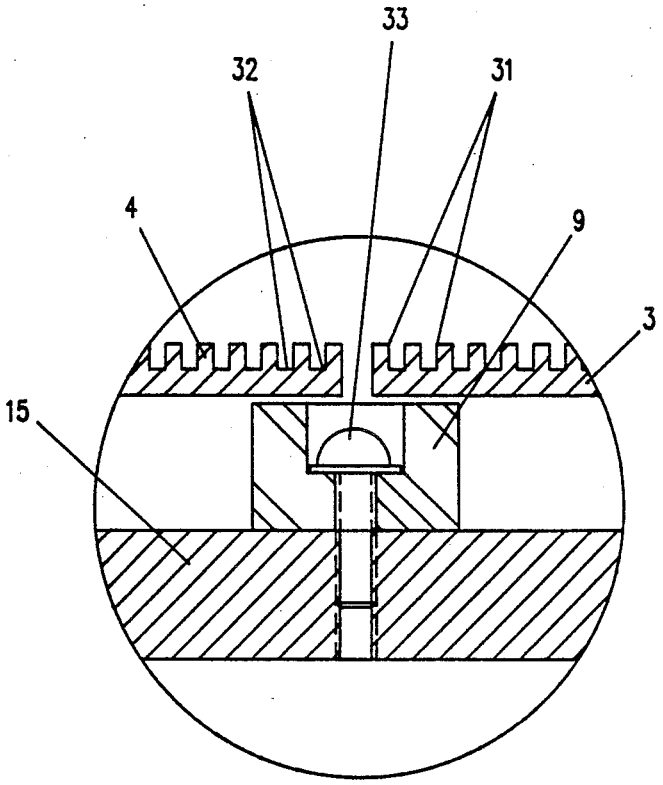
FIG. 3 is a cross-sectional view of a portion of the anode of FIG. 1.

In FIG. 3, taken along the lines 3—3 in FIG. 1, the anode module face plate members 3 have blade elements 4. These blade elements 4 have cathode-facing front face areas 31 as the forward most area of the elements 4 and have three-sided slots 32 between the front face areas 31. At their adjacent edges, the face plate members 3 of the blade elements 4 are slightly spaced apart. Positioned at this slight spacing between edges, but situated beneath the face plate members 3, is an impact-absorbing, dielectric strip 9 or compression support 9. This compression support 9 is fastened to the support plate 15 by means of a countersunk bolt 33. As can be best viewed by referring to the FIGS. 2B and 3, some of the dielectric strip members, i.e., the dielectric strips 7 of FIG. 2B can project outwardly beyond the face plate members 3 as well as separate such members 3 at their edges. Also, some dielectric strip members, i.e., the dielectric strips 9 of FIG. 3 can be positioned at edges of face plate members 3, but the face plate members 3 are themselves separated one from the other.

In assembly, the front of the support plate 15 can initially have the dielectric strips 7 bolted to the plate 15 and extending across the face of the plate 15. Then the compression supports 9 can be bolted on the plate 15 and interposed between the dielectric strips 7. At this point in the assembly, the support plate 15 thus has a network, in the form of a grid of parallelogram-shaped zones of typically horizontal strips 7 and vertical strips 9 mounted on the plate 15. The busswork, e.g., buss connector 13 can be secured to the back of the support plate by means of the buss fasteners 18. For a module 2, the blade elements 4 may be welded to the metal face member 3. At the back of the module 2, a metal connector 16, which has been plated at one end, has the opposite end welded to the face member 3. Then the blade elements 4 on the face member 3, including face areas 31 and intervening slots 32, can receive a coating for providing an active anode surface. Next the insulating strips 10 can be secured in the groove 5 on the face member 3 of the module 2. The module assembly thus prepared may then be secured to the support plate 15 to complete the assembly of the module 2 with the plate 15. When all modules 2 have been so secured, the plate 15 may then be equipped with edge mask guides 12 and support arms and be ready for installation in an electrolytic cell.

Owing to the construction of the face members 3 being in individual modules 2 and being spaced apart by the connectors 16 from the support plate 15, the massive anode 1 has at least substantial inflexibility. By that it is meant that the anode 1 is not free to move in the cell, except as by adjustment through the support arms, but has the projecting modules 2 which if hit for example by a moving cathode will be able to at least slightly deflect to absorb such a blow, as through the face members 3 and the compression supports 9. The ability to absorb such a blow as may occur at only part of the face of the anode is thus facilitated by the non-interconnection of the modules 2 and their placement in rows and tiers as spaced-apart, separate units. Also, the dielectric strips 7 as well as the insulating strips 10 can be compressible, further adding to the slight flexibility of the overall massive anode 1.

The support plate 15 for initiating anode 1 assembly will preferably have an at least substantially flat surface. This can contribute to an at least essentially constant anode to cathode gap across the face of the anode 1, e.g., a gap of usually about one inch, but may be more such as 1.5 to 3 inches. It is however to be understood that other configuration, e.g., a curvilinear support plate 15 may be serviceable, generally depending upon the dimensions of the cell for which the anode is to be used. It is contemplated that although other designs may be used, the metal connectors 16 will essentially always be of uniform dimension, and the face plate members 3 for any massive anode 1 will all have at least substantially the same thickness, whereby upon assembly of the massive anode 1 the active anode front faces will be at least essentially in a common plane presenting an at least generally planar front face for the anode 1.

Although the modular anodes 2 have been shown with face plate members 3 having blade elements 4, it is to be understood that such face plate members 3 may be flat or contain raised elements protruding or projecting therefrom in differing configurations other than blades. For, however, maintaining an at least generally constant anode to cathode gap and therefor for providing the at least generally planar anode surface as offered by blades, it is advantageous that other configurations be selected with these criteria in mind.

Where protruding elements are employed, these are preferably spaced apart from, and parallel to, one another and vertically oriented, so as to accommodate flow, e.g., gas release, during electrolysis operation. Also, where a cathode is moving upwardly from bottom to top across the face of the anode of FIG. 1, vertically oriented parallel elements can facilitate minimizing frictional losses in electrolyte flowing across the face of the anode. Although the face plate member 3 has been shown to be a solid, non-perforate plate, it is also contemplated that such member may be perforate, e.g., a traditional perforate plate, woven wire, expanded metal or metal mesh or the like, so long as when utilized such as in an electrodeposition process wherein a usually constant anode to cathode gap will be preferred, that such a plate maintains at least substantial rigidity sufficient to accommodate such constant gap characteristic. Furthermore, although it has been shown to have a square face, it is contemplated that any general parallelogram shape of typically at least substantially vertical and horizontal edges for the face plate member 3, e.g., a rhombus, will be suitable. In such a case, the gridwork of the dielectric members 7,9 will be of similar shape to the outline of the face plate member 3. For the face plate member 3, as well as for the blade elements 4, it is contemplated that the materials of construction that will be used are non-consumable in the environment and include the refractory metals titanium, columbium, tantalum and the like, which are coated with a catalytically active coating.

The face plate member 3 has been shown to contain a central groove 5 for containing the insulator strip 10. It is, however, to be understood that such strips 10 may be present as two or more, typically in parallel to one another, and neither of which needs to be centrally located on the face plate member 3. Moreover, although the long axis of such strips 10 have been shown to be positioned transverse to the long axis of the blade elements 4, it is contemplated that other arrangements, e.g., parallel positioning of elements 4 to strips 10, may be utilized. In any event, the strips 10 will be on the face plate member 3 apart from said elements 4 and should always be dimensioned sufficiently large enough to project outwardly closest to the cathode for all of the elements of the modular anode. This projection will assist in protecting the anode from cathode contact. The strips 10, along with the dielectric strips 7, thus serve as the projecting elements to initially receive and absorb contact from a moving cathode. These strips 7,10 are preferably linear or longitudinal-shaped, as shown in the figures, and for the insulator strips 10, extend from edge-to-edge on the plate member 3, although other configuration and length is contemplated. Likewise, the dielectric strips 7 preferably extend from edge-to-edge of the support plate 15, although differing strips 7, e.g., segmented along the plate 15, can also be serviceable. Moreover, although the dielectric strips 7 are generally T-shaped in cross-section, or L-shaped as for the strips 7A, and the insulator strips 10 as shown as generally rectangular, other shapes are contemplated, e.g., U-shape or truncated star shape.

It is contemplated that these strips 10 and 7 may be of the same or similar insulating materials. Usually such will be deformable plastic materials, including the thermoplastics such as polyolefin materials. A representative suitable substance for these strips is ultra high molecular weight polyethyelene, as well as polypropylene or the halogenated resins, e.g., polytetrafluoroethyelene and fluorinated ethylene-propylene resin. It is also contemplated to use ceramic materials for these strips 10 and 7, e.g., strips of alumina or zirconia, which have desirable abrasion resistant property. Likewise, the dielectric strips that are the compression supports 9 can be made from the same or similar materials as for these strips 7,10. The supports 9 may also be of differing cross-section than the U-shape as shown, e.g., B-shaped. The material selected for the compression supports 9 should be resistant to the environment, e.g., resistant to the electrolyte environment in which the anode will be used. It will also advantageously be deformable, so as to absorb impact such as from the cathode, as well as be resistant to abrasion. For absorbing impact without deleterious abrasion or degradation the strips 7 and 10 can have beveled or chamfered edges.

For the metal connectors or bosses 16, these can be made of a suitably electrically conductive metal that is also resistant to the electrolyte environment. Such metals as are contemplated for use for these bosses 16 include the refractory metals, e.g., titanium and columbium. Advantageously, for good electrical conductivity coupled with desirable resistance to the environment, the metal for the conductor will be titanium. Such connector 16 can be firmly affixed to the face plate members 3, as by welding, e.g, laser welding, tungsten inert gas welding or metal inert gas welding. The connector 16 will have a different constituency, i.e., a different metallurgical make-up, for interface contact with the support plate 15. Such constituency difference is a metallurgical difference at the connector surface that is different from the general composition of the connector. For example if the connector is of titanium or titanium alloy, which is then the general composition of the connector, then the metallurgical difference for a connector surface may be a plated metal surface of a metal other than the titanium or alloy. This metallurgical difference can serve to enhance contact between the connector 16 and adjoining electrically conductive elements. Advantageously for best electrically conductive connection, as well as resistance to electrolyte, it is desired that this difference in constituency be provided by coating of the connector surface. However, other change, as by alloying of the surface, may be useful. Where a coating is utilized, electrocoating operation is preferred for economy, although other coating operations, e.g., brush plating, plasma arc spraying or vapor deposition, may be employed. For the preferred metal titanium for the connector 16, it is advantageous to use a plated noble metal coating. Such a noble metal coating is a coating of one or more of the Group VIII or Group IB metals having an atomic weight of greater than 100, i.e., the metals ruthenium, rhodium, palladium, silver, osmium, iridium, platinum and gold. Preferably for efficiency in enhanced electrical contact, platinum plating is used.

For the support plate 15, it is contemplated to use any metal suitably resistant to the electrolyte and desirably electrically conductive. Such metals include the valve metals, e.g., tantalum, titanium and columbium. Advantageously for combining electrical conductivity with resistance to electrolyte, the support plate 15, in electrogalvanizing operation, is titanium or a titanium clad or plated metal, e.g., titanium clad steel. The support plate 15, although preferably a solid titanium sheet for ruggedness combined with electrical conductivity and resistance to electrolyte, may be of other configuration, such as a perforate plate or open framework. The fasteners, e.g., for coupling the metal connector 16 to the support plate 15 or for binding the compression support 9 to the support plate 15, can be of the same or similar metals as for the support plate 15. Although such have been shown to be threaded, they may be otherwise, e.g., riveted to the support plate 15 or be threaded studs that are welded, as to the support plate 15.

For the buss connectors 13, it is most desirable to use a highly conductive metal, e.g., copper. These connectors 13 can be bolted to the support plate 15, as by fasteners 18 of copper, copper alloy or steel, including stainless and high strength steel. Since copper metal might be subject to attack, as from the electrolyte in an electrogalvanizing environment, the copper busswork will usually be covered, including cladding, plating, explosion bonding or welding, with a more inert metal, i.e., a valve metal. Hence, explosion bonded titanium sheets, for example, can protect the face of the buss connectors 13, while edges can have strips of titanium welded thereto for affording complete protection for underlying copper metal.

The face plate members 3, as well as any contiguous, projecting members, e.g., blade elements 4, will advantageously for best anodic activity, contain an electrocatalytic coating. Such will be provided from platinum or other platinum group metal, or it may be any of a number of active oxide coatings such as the platinum group metal oxides, magnetite, ferrite, cobalt spinel, or mixed metal oxide coatings, which have been developed for use as anode coatings in the industrial electrochemical industry. The platinum group metal or mixed metal oxides for the coating are such as have generally been described in one or more of U.S. Pat. Nos. 3,265,526, 3,632,498, 3,711,385 and 4,528,084. More particularly, such platinum group metals include platinum, palladium, rhodium, iridium and ruthenium or alloys of themselves and with other metals. Mixed metal oxides include at least one of the oxides of these platinum group metals in combination with at least one oxide of a valve metal or another non-precious metal.

Where the face plate members 3 are configured with blade elements 4 or the like, it is advantageous that the cathode-facing face areas 31 have an area at least equal to the projected area of the slots 32. That is, the ratio of the face areas 31 to the projected area of the slots 32 is at least about 1:1. Such area ratio for the face areas to the projected slotted areas will lead to reduced anode overvoltage owing to a lowered average operating current density. Moreover, occasional short circuits which can damage the coating on the face areas 31 of the blades, will not affect the slotted areas 32. Preferably for best operating life of the coating, such ratio will be at least about 3:1 and may even be greater, e.g., 4:1 to 5:1 or more.

The edge mask guides 12 can serve to guide and align the adjustable edge masks at the edges of the cathode, e.g., a steel strip cathode. The edge masks may be utilized to reduce or control unwanted electrolytic deposition onto a cathode that is intended to be coated on one side only. Thus the edge mask guides 12 can be longitudinal, fin-like side members that fit snugly into the edge of the anode 1. Suitable materials of construction for such guides 12 are the same as for the strips 10 and 7. Hence, a polyolefin material such as ultra high molecular weight polyethylene may be used for these guides 12 where the anode 1 is used in electrogalvanizing operation and the guides are to combine desirable ruggedness of construction with resistance to the electrogalvanizing medium.

The anode 1 can also contain support arms, jutting out in a position sideways to the anode 1 as it is depicted in FIG. 1. Such support arms can be positioned both above and below the edge mask guides 12. These support arms may incorporate adjustable support bearings or cams which allow for adjustment of the anode to cathode gap, even after the anode 1 has been positioned, as in an electrogalvanizing cell tank. These arms can be of similar materials of construction as for the support plate, e.g., titanium clad steel.

I claim:

1. A massive anode of generally planar shape and at least substantial inflexibility, which contains an array of modular anodes and is adapted for use with a facing, moving cathode, including movement towards said anode, which anode comprises:

a multitude of individual and non-consumable modular anodes having planar-shaped, electrically conductive metal members having active anode front faces in a common plane, thereby presenting a generally planar front face for said anode, each modular anode being in firm, electrically conductive contact with, an electrically conductive support plate member serving as a current distributor member for said modular anodes a series of linear, dielectric strip members mounted on said support plate member and positioned next to at least some of the edges of adjacent modular anodes, including dielectric strip members that project forwardly beyond the front faces of said modular anodes toward said facing cathode, and metal connector means securing each modular anode in electrical connection to said support plate member while spacing each modular anode and support plate member apart from one another.

2. The massive anode of claim 1, wherein said active anode front faces are solid, non-perforate faces having at least one longitudinal-shaped insulator member extending across said front face, said insulator member being dimensioned and positioned to protect said active anode face from contact with said facing cathode.

3. The massive anode of claim 2, wherein said planar member front face, in the area apart from said insulator member, contains a series of projecting and active anode elements, projecting toward said facing cathode and spaced apart one from each in parallel, relationship.

4. The massive anode of claim 3, wherein said projecting and active anode elements are blades.

5. The massive anode of claim 3, wherein said projecting and active anode elements have cathode-facing, front face area as the forward most area thereof; and a balance of slotted area, and the ratio of the front, face area to the projected area of the slots is at least about 1:1.

6. The massive anode of claim 3, wherein said projecting and active anode elements are positioned on said front face crosswise to the axis of said longitudinal-shaped insulator member.

7. The massive anode of claim 1, wherein said modular anodes are refractory metal anodes having active anode metal member front faces containing an electrocatalytic coating.

8. The massive anode of claim 7, wherein said electrocatalytic coating contains a platinum group metal or contains at least one oxide selected from the group consisting of platinum group metal oxides, magnetite, ferrite and cobalt oxide spinel.

9. The massive anode of claim 7, wherein said electrocatalytic coating contains a mixed oxide material of at least one oxide of a valve metal and at least one oxide of a platinum group metal.

10. The massive anode of claim 1, further characterized by containing support arms.

11. The massive anode of claim 1, further characterized by containing edge guide means.

12. The massive anode of claim 1, wherein said metal connector means has a portion abutting against said support plate member, which portion is a different metal composition than the general metal composition of said connector.

13. The massive anode of claim 1, wherein said metal connector means is affixed to said planar metal member at least in part by welding.

14. The massive anode of claim 1, wherein said support plate member is a rigid, solid, non-perforate metal member.

15. The massive anode of claim 1, wherein said support plate member is a solid titanium sheet.

16. The massive anode of claim 1, wherein said support plate member is spaced apart from said planar shaped metal members by refractory metal connector means.

17. The massive anode of claim 1, wherein each modular anode around the perimeter of the front face is spaced apart from adjacent modular anodes.

18. The massive anode of claim 1, wherein at least some of said dielectric strip members are positioned between parallel edges of adjacent modular anodes and divide said modular anodes into rows.

19. The massive anode of claim 1, wherein said dielectric strip members are abrasion resistant ceramic members or deformable plastic members.

20. The massive anode of claim 1, wherein edges of modular anodes not separated by said dielectric strip members are spaced apart, one from each other, and the spaced edges have dielectric strip members mounted on said support plate and positioned between said plate and said planar shaped metal member.

21. The massive anode of claim 1, further characterized by said support plate member containing buss elements providing electrical connection for said anode exterior to a cell.

22. The massive anode of claim 21, wherein said buss elements are metal coated copper elements.

23. A non-consumable modular anode adapted for forming, as an array of like anodes, the massive and at least substantially inflexible anode of claim 1, wherein said modular anode is secured to an electrically conductive support member serving as a current distributor member for said anode, which said modular anode comprises a planar-shaped, electrically conductive metal member having an active anode front face opposing a facing, moving cathode, at least one insulator member extending across the front face of said planar metal member, said insulator member being dimensioned and positioned to protect said front face from unwanted contact with said moving cathode, a metal connector securely fixed in electrical connection with a back face of said planar metal member and with at least a portion of a rearwardly facing surface of said metal connector of different metal composition than the general metal composition of said connector, with said rearwardly facing surface of different metal composition being securely fixed in electrical connection with said support member upon assembly of said massive anode.

24. The anode module of claim 23, wherein said insulator member is a longitudinal-shaped, chamfered-edged member in strip form, and said member in strip form extends across the front face of said planar metal member from edge-to-edge in at least the central portion thereof.

25. The anode module of claim 24, wherein said insulator member in strip form is a plastic or ceramic member.

26. The anode module of claim 25, wherein said plastic member is a polyolefin member.

27. The anode module of claim 23, wherein said planar metal member front face is a solid, non-perforate face containing a series of active anode elements projecting toward said cathode, in parallel relationship and spaced apart one from each other, and situated on said front face apart from said insulator member.

28. The anode module of claim 27 wherein said projecting active anode elements are blade shaped.

29. The anode module of claim 27, wherein said projecting active anode elements have cathode-facing, front face area as the forward most area thereof, and a balance of slotted area, and the ratio of the front face area to the projected area of the slots is at least about 1:1.

30. The anode module of claim 27, wherein said projecting active anode elements are positioned on said front face crosswise to the long axis of said longitudinal-shaped insulation member.

31. The anode module of claim 23, wherein said front face contains an electrocatalytic coating.

32. The anode module of claim 31, wherein said electrocatalytic coating contains a platinum group metal or contains at least one oxide selected from the group consisting of platinum group metal oxides, magnetite, ferrite and cobalt oxide spinel.

33. The anode module of claim 31, wherein said electrocatalytic coating contains a mixed oxide material of at least one oxide of a valve metal and at least one oxide of a platinum group metal.

34. The anode module of claim 23, wherein said metal connector is secured to said planar metal member at least in part by welding.

35. The anode module of claim 23, wherein said rearwardly facing surface of said metal connector of different metal composition is a plated metal coating of noble metal.

36. The anode module of claim 35, wherein said noble metal coating is a coating of one or more of Group VIII or Group IB metals having an atomic weight of greater than 100.

37. The anode module of claim 35, wherein said noble metal coating is in firm, electrically conductive contact with said support member upon assembly of said massive anode.

38. In a massive anode for positioning in an electrolysis medium, wherein said anode comprises an electrically conductive support plate member serving as a current distributor for a multitude of individual modular anodes electrically connected in firm engagement with said support plate, and wherein metal buss work which will be in contact with said electrolysis medium, supplies electrical current to said support plate, wherein the improvement comprises buss work for said anode of a highly electrically conductive first metal susceptible to degradation by contact with said electrolysis medium, which first metal buss work is electrically connected to said support plate, with said first metal being enveloped in an electrically conductive corrosion resistant second metal and with said second metal being fixedly secured in electrically conductive contact with said first metal on outer surfaces thereof.

39. The anode of claim 38, wherein said first metal is copper and said second metal is a refractory metal.

40. The anode of claim 38, wherein said electrolysis medium provides for a zinc-containing deposit on a cathode and said second metal is titanium.

41. The anode of claim 38, wherein said second metal is fixedly secured to said first metal by explosion bonding or by welding.

42. The anode of claim 38, wherein said buss work provides structural support for said anode.

43. An anode of claim 1, wherein the anode is used as an anode in an electrogalvanizing cell, the cell has a moving cathode comprising a strip of steel moving in a direction transverse to at least some of said dielectric strip members of said anode, the anode and cathode are spaced closely together and the anode is mounted in the cell in a manner that the spacing is adjustable.

44. An electrode support plate, which plate is a current distributor for electrodes electrically connected to said plate and projecting outwardly therefrom, said support plate having on a broad face thereof a network of at least substantially vertical and horizontal, abrasion-resistant and deformable dielectric strip members, said strip members being arranged in the manner of at least substantially vertical and horizontal pairs forming parallelogram-shaped zones on said support plate.

45. The support plate of claim 44, wherein strip members in one direction are strip members of greater projection, while strip members of the other direction are strip members of lesser projection, and all members project outwardly away from said support plate.

46. The support plate of claim 45, wherein said strip members of greater projection project outwardly from said support plate beyond said electrodes, while said strip members of lesser projection are recessed behind projecting electrodes.

47. The support plate of claim 44, wherein said strip members have cross-section of one or more of T-shape, U-shape, L-shape, B-shape or truncated star shape.

48. An electrogalvanizing assembly comprising a moveable cathode for receiving a metallic zinc-containing deposit, an electrolyte for providing said zinc-coating deposit on said cathode during electrolysis, said assembly further including the massive, inflexible anode of claim 1.

49. The electrogalvanizing assembly of claim 48, wherein said anode and cathode are spaced closely together and the anode is mounted in the assembly in a manner that the spacing is adjustable.

50. A rigid metal anode comprising a generally planar rigid metal support carrying on a front surface thereof a plurality of active anode elements making up a planar active anode face, the support acting as current distributor for the active anode elements, characterized in that the active anode elements are an array of discrete planar anode elements arranged side-by-side to make up the total planar active anode face and securely fixed as individual modules in electrical connection with the support, the planar anode elements further being positioned for support and at least in part being spread apart one from each other by a series of dielectric spacing members, the dielectric spacing members comprising parts that project forwardly beyond the planar active anode face to protect said face against unwanted contact with a facing cathode.

* * * * *